United States Patent [19]

Miasek et al.

[11] 4,147,612

[45] Apr. 3, 1979

[54] REGENERATION OF ALKALI METAL SULFIDES FROM ALKALI METAL HYDROSULFIDES

[75] Inventors: Peter G. Miasek; John J. Dugan, both of Sarnia, Canada

[73] Assignee: Imperial Oil Enterprises Ltd., Toronto, Canada

[21] Appl. No.: 876,904

[22] Filed: Feb. 13, 1978

[51] Int. Cl.[2] ..... C10G 13/06; C01B 17/26

[52] U.S. Cl. ..... 208/108; 208/209; 208/235; 252/436; 423/37; 423/561 A; 423/563; 423/572

[58] Field of Search ..... 208/108; 423/561, 37, 423/92, 101, 140

[56] References Cited

U.S. PATENT DOCUMENTS

| | | | |
|---|---|---|---|
| 2,106,952 | 2/1938 | Konig | 423/561 A |
| 4,119,528 | 10/1978 | Baird et al. | 208/108 |

*Primary Examiner*—Delbert E. Gantz
*Assistant Examiner*—G. E. Schmitkons
*Attorney, Agent, or Firm*—Marthe L. Gibbons

[57] ABSTRACT

Alkali metal sulfides are regenerated from alkali metal hydrosulfides which are produced as a result of the hydroconversion of heavy carbonaceous feeds. The regeneration is effected by contacting the alkali metal hydrosulfide with a metal oxide at elevated temperatures.

11 Claims, No Drawings

REGENERATION OF ALKALI METAL SULFIDES FROM ALKALI METAL HYDROSULFIDES

FIELD OF THE INVENTION

The present invention relates to the regeneration of an alkali metal sulfide from an alkali metal hydrosulfide, the former being an active reagent for the hydroconversion and desulfurization of sulfur-containing hydrocarbon feedstocks. More particularly, the present invention relates to the regeneration of an alkali metal sulfide, wherein said alkali metal sulfide can be recycled to a hydroconversion reactor for further use therein.

DESCRIPTION OF THE PRIOR ART

Conversion of heavy hydrocarbon feeds to more valuable distillate products, such as gasoline, naphtha, fuel oil and heating oil, by contacting such feeds in the presence of high pressure hydrogen, with alkali metal sulfides is known. During the hydroconversion process, the alkali metal sulfide reacts with organically bound sulfur, or with hydrogen sulfide liberated thermally, to produce an alkali metal hydrosulfide, which is inactive for hydroconversion.

Heretofore, the formation or regeneration of the alkali metal sulfide from an alkali metal hydrosulfide was accomplished by reaction of the hydrosulfide with the alkali metal hydroxide according to the following equation, where A represents an alkali metal:

$$ASH + AOH \rightarrow A_2S + H_2O \uparrow$$

The disadvantage to this method was that the alkali metal hydroxide was itself converted to the alkali metal sulfide, thus necessitating regeneration of the hydroxide.

Conversion of alkali metal sulfides or hydrosulfides back to the hydroxide is known in the art, but is difficult and expensive to accomplish. Thus, due to the undesirability of a regeneration using alkali metal hydroxides, an economical process for regenerating the alkali metal sulfide from the alkali metal hydrosulfide was sought.

SUMMARY OF THE INVENTION

In accordance with this invention, an efficient and simple conversion of an alkali metal hydrosulfide to an alkali metal sulfide is presented wherein the alkali metal hydrosulfide is contacted with a metal oxide under specific conditions to thereby chemically convert the hydrosulfide back to the sulfide. The alkali metal sulfide can then be used in the hydroconversion and desulfurization of sulfur-containing hydrocarbon feedstocks. This reaction occurs according to the following equation wherein A represents an alkali metal and M represents a metal:

$$2ASH + MO \rightarrow A_2S + MS + H_2O \uparrow$$

Depending upon the nature of the metal M, the reaction will be carried out at a temperature between ambient and 1700° F. and at substantially atmospheric pressure. The metal oxide is added to the hydrosulfide in the form of a solid, the hydrosulfide generally being in the solid state as well. Further, depending upon the precise metal M utilized and the temperature of the reaction, the reaction may be carried out in the molten hydrosulfide or in an aqueous slurry. Alternatively, a continuous process in which an aqueous solution of alkali metal hydrosulfide is passed over a fixed bed of metal oxide may be employed. Typical reaction time should be from 0.1–4 hours.

The particular metals which may be employed in the above process of the present invention include copper, mercury, calcium, cadmium, manganese, nickel, lead, tin, and zinc. It is noted, depending upon the nature of the metal, the temperature required for the reaction will vary and will be determined according to the relative thermodynamic stability of the metal sulfide versus the metal oxide for any given metal. Thus, metals (e.g., mercury) where the free enthalpy of the sulfide is only slightly less negative than for the oxide, will react at relatively low temperatures. On the other hand, metals (e.g., calcium) where the free enthalpy of the sulfide is much less negative than the oxide, will require higher temperatures. Metals such as copper, for example, will fall somewhere between these two extremes.

It has also been found that the metal sulfides, MS, thus produced do not impair the hydroconversion activity of the alkali metal sulfide. Thus, they need not be separated from the alkali metal sulfide and can be recycled therewith to the hydroconversion reactor, thus greatly simplifying the overall process. Alternatively, if desired, dissolution of the salts in water followed by filtration to remove the insoluble metal sulfides will effect a relatively easy separation.

The metal oxide itself can be regenerated by various methods known in the art including, for example, high temperature air roasting. Additionally, treatment of the metal sulfide with steam at a temperature of 700°–1700° F. for 15 minutes-6 hours at atmospheric pressure may be effected and is the preferred method of regeneration, such treatment occurring according to the following equation:

$$H_2O + MS \rightarrow MO + H_2S \uparrow$$

The alkali metal sulfides which may be employed in the present invention generally include the sulfides of those metals contained in Group 1-A of the Periodic Table of Elements. Specifically, it has been found that the sulfides of lithium, sodium, potassium, rubidium and cesium are particularly useful in this process. The preferred sulfide is potassium sulfide due to its ready availability as well as the ease with which it may be recovered and regenerated for further use. The metal oxides which may be employed in the regeneration step preferably include the oxides of calcium and copper, but the oxides of mercury, cadmium, manganese, nickel, lead, tin and zinc may be employed as well.

DESCRIPTION OF PREFERRED EMBODIMENT

The process of this invention will be described by reference to the following Examples:

EXAMPLE 1

52.5 gm of solid potassium hydrosulfide is introduced into a 0.5 liter graphite tube reactor which is maintained at substantially atmospheric pressure, along with 50 gm of solid calcium oxide. The reactor is flushed with a helium sweep gas at the rate of 1.8 liters per minute. The temperature of the reactor is raised to 1700° F. and the reaction allowed to continue for about 45 minutes after which time the reaction is virtually complete. Steam is released as the major gaseous product of the reaction. However, as a result of the reaction of the steam with the graphite liner on the reactor, small amounts of carbon monoxide and carbon dioxide are produced.

The potassium sulfide produced as a result of this regeneration can be recycled to the hydroconversion reactor, along with any metal sulfide formed as well as any unreacted metal oxide. The recycled product exhibits substantially equivalent activity during the hydroconversion process as potassium sulfide formed by conventional means.

Table I gives the results of a hydroconversion process conducted using conventionally prepared potassium sulfide. Table II gives the results of a hydroconversion process conducted using potassium sulfide which has been regenerated from potassium hydrosulfide according to the process of this invention. Hydroconversion conditions in both instances were the same, the feedstock employed being a 650° F.+ Safaniya Residuum (4.2% S, 13.1% CCR, 120 ppm Ni and V), introduced into a three liter autoclave, together with 2000 SCF/B $H_2$, to achieve a pressure within the autoclave of 2000 psig, the reactor being maintained at a temperature of 750° F. and the time of reaction with the potassium sulfide being one hour. In both instances, the potassium sulfide was in powdered form.

The results shown clearly demonstrate the effectiveness of potassium sulfide as a hydroconversion agent, as well as the substantial equivalence, for this purpose, of potassium sulfide produced according to the process of this invention.

TABLE I

| | |
|---|---|
| Weight % Reagent on Feed ($K_2S$) | 15 |
| Product Yields, Weight % | |
| $H_2S$ | 2.2 |
| $C_1C_4$ Gas | 1.4 |
| $C_5$+ Liquid | 96.3 |
| Coke | 0.1 |
| $C_5$+ Liquid Inspections | |
| S, Weight % | 2.1 |
| CCR, Weight % | 8.7 |
| Ni/V, ppm | 8/26 |
| Desulfurization, % | 52 |
| Demetallization, % | 73 |
| CCR Conversion to Distillate, % | 35 |

TABLE II

| | |
|---|---|
| Weight % Reagent on Feed ($K_2S$/CaS/CaO) | 5.7/4.7/5.4 |
| Product Yields, Weight % | |
| $H_2S$ | 1.6 |
| $C_1/C_4$ Gas | 1.3 |
| $C_5$+ Liquid | 97.1 |
| Coke | 0.0 |
| $C_5$+ Liquid Inspections | |
| S, Weight % | 2.7 |
| CCR, Weight % | 9.3 |
| Ni/V, ppm | 26/16 |
| Desulfurization | 37 |
| Demetallization, % | 66 |
| CCR Conversion to Distillate, % | 31 |

EXAMPLE 2

18.9 gm KSH were disslved in 50 gm $H_2O$ and 14.6 gm of solid, orange HgO added. The resulting slurry was stirred for 15 minutes at room temperature and atmospheric pressure. Approximately 15.1 gm of black solid was formed which was tested and found to be HgS. This was taken as evidence that 50% of th KSH, which corresponds to the theoretical maximum conversion for that amount of HgO, was regenerated to $K_2S$ according to the following equation:

$$2KSH + HgO \rightarrow HgS + K_2S + H_2O$$

EXAMPLE 3

14 gm of KSH were dissolved in 25 gm $H_2o$ and 7.7 gm CuO added. The resulting slurry was stirred for 15 minutes at room temperature and atmospheric pressure. 10.3 gm of solid were formed, tested, and found to be 70% CuS, 30% CuO. This result established that 70% of the KSH was converted to $K_2S$, the theoretical maximum conversion equalling 100%.

EXAMPLE 4

13.7 gm of KSH were dissolved in 25 gm of $H_2O$ and 5.1 gm of $Fe_2O_3$ added. The slurry was stirred, as in the foregoing Examples, for 15 minutes at room temperature and atmospheric pressure. No reaction was detected.

While the invention has been described with a certain degree of particularity, it will be understood that the description was by way of example only and that numerous variations and modifications, as may become apparent to those of ordinary skill in the art, can be made without departing from the spirit and the scope of the invention as hereinafter claimed.

What is claimed is:

1. A process for the conversion of an alkali metal hydrosulfide to an alkali metal sulfide, which comprises contacting said alkali metal hydrosulfide with a metal oxide thereby producing said alkali metal sulfide.

2. The process of claim 1 wherein the alkali metal of said alkali metal hydrosulfide and said alkali metal sulfide comprises an alkali metal selected from the group consisting of sodium, lithium, potassium, rubidium, cesium, and mixtures thereof.

3. The process of claim 1 wherein said alkali metal of said alkali metal hydrosulfide and said alkali metal sulfide comprises potassium.

4. The process of claim 1 wherein said metal oxide comprises an oxide of a metal selected from the group consisting of calcium, copper, mercury, cadmium, manganese, nickel, lead, tin, and zinc.

5. The process of claim 1 wherein said metal oxide is copper oxide.

6. The process of claim 1 wherein said metal oxide is calcium oxide.

7. The process of claim 1 wherein the alkali metal hydrosulfide is obtained from spent solids in a hydroconversion reactor subsequent to hydroconversion of a heavy hydrocarbon sulful-containing feedstock by contact with an alkali metal sulfide.

8. The process of claim 7 wherein the alkali metal sulfide which has been regenerated from the alkali metal hydrosulfide is recycled to said hydroconversion reactor for use as a hydroconversion reagent.

9. The process of claim 8 wherein said metal sulfide produced during the conversion of said alkali metal hydrosulfide to said alkali metal sulfide, is separated from the alkali metal sulfide prior to said recycling.

10. The process of claim 9 wherein said metal sulfide is treated with steam to produce a metal oxide.

11. The process of claim 10 wherein the metal oxide is used for conversion of the alkali metal hydrosulfide to the alkali metal sulfide.

* * * * *